US007874499B2

(12) United States Patent
Lochtefeld

(10) Patent No.: US 7,874,499 B2
(45) Date of Patent: Jan. 25, 2011

(54) SYSTEM AND METHOD TO CONTROL SENSIBLE AND LATENT HEAT IN A STORAGE UNIT

(75) Inventor: Joseph R. Lochtefeld, New Bremen, OH (US)

(73) Assignee: Store-N-Stuff LLC, New Bremen, OH (US)

( * ) Notice: Subject to any disclaimer, the term of this patent is extended or adjusted under 35 U.S.C. 154(b) by 514 days.

(21) Appl. No.: 11/603,452

(22) Filed: Nov. 22, 2006

(65) Prior Publication Data

US 2008/0116289 A1 May 22, 2008

(51) Int. Cl.

| | |
|---|---|
| ***F24F 3/14*** | (2006.01) |
| ***F23N 5/10*** | (2006.01) |
| ***F25B 13/00*** | (2006.01) |
| ***F25B 7/00*** | (2006.01) |
| ***F25B 49/00*** | (2006.01) |
| ***F25B 41/00*** | (2006.01) |
| ***F25B 1/00*** | (2006.01) |

(52) U.S. Cl. ..... 236/44 C; 62/160; 62/175; 62/176.1; 62/176.3; 62/203; 62/324.1; 62/324.6; 62/498; 236/9 R

(58) Field of Classification Search ..... 236/44 C; 62/324.6, 324.1, 160, 175, 176.1–176.6, 62/180, 185, 203, 498
See application file for complete search history.

(56) References Cited

U.S. PATENT DOCUMENTS 4,809,516 A * 3/1989 Jones ..... 62/160
5,586,449 A * 12/1996 Krist ..... 62/179
6,450,411 B1 9/2002 Rash et al.
6,711,907 B2 3/2004 Dinnage et al.
2001/0003286 A1* 6/2001 Philippbar et al. ..... 137/624.12
2004/0216469 A1* 11/2004 Viegas et al. ..... 62/50.2
2005/0044869 A1* 3/2005 Goth et al. ..... 62/259.2
2006/0230770 A1* 10/2006 Kitsch ..... 62/151

* cited by examiner

*Primary Examiner*—Frantz F Jules
*Assistant Examiner*—Travis Ruby
(74) *Attorney, Agent, or Firm*—Dinsmore & Shohl LLP

(57) ABSTRACT

A climate control system for a storage unit. The system includes a reverse cycle chiller; a fluid supply line in fluid communication with an outlet of the fluid side heat exchanger; a fluid return line in fluid communication with an inlet of the fluid side heat exchanger and the fluid supply line; at least one hydronic coil in optional fluid communication with the fluid supply line and the fluid return line, the at least one hydronic coil located in a room to be controlled; a controller in communication with the reverse cycle chiller and the at least one hydronic coil; an ambient temperature sensor in communication with the controller; an ambient humidity sensor in communication with the controller; a room temperature sensor in communication with the controller, the room temperature sensor positioned in the room; and a room humidity sensor in communication with the controller, the room humidity sensor positioned in the room. A method of controlling the climate in a storage unit is also described.

20 Claims, 4 Drawing Sheets

SYSTEM AND METHOD TO CONTROL SENSIBLE AND LATENT HEAT IN A STORAGE UNIT

BACKGROUND OF THE INVENTION

This invention relates to air conditioning and dehumidification equipment and more particularly to air conditioning and dehumidification equipment for storage units.

It is well known that traditional air conditioning designs are not well adapted to handle both the moisture load and temperature load of a building space. In conventional air conditioning systems, the cooling capacity of the air conditioner unit is typically sized primarily to accommodate the sensible (dry-bulb temperature) load and corresponding latent (humidity) load at a peak temperature design condition.

However, the humidity load in an enclosed space does not vary directly with the temperature load. Consequently, during the morning and night time hours, the humidity outdoors is approximately the same as during the higher temperatures found throughout the midday periods. Thus, during the cooler periods in the morning and night time, there is a demand for dehumidification but no cooling requirements. Since most of conventional or standard air conditioning designs do not address a separate latent (humidity) load without a sensible load, it results in uncomfortable conditions within the building.

The American Society of Heating, Refrigeration and Air-Conditioning Engineers (ASHRAE) describe comfort zone conditions for human occupancy with a temperature range of about 73-78° F. and a moisture content between about 55-71 gr./lb. or a relative humidity less than about 60%.

Uncontrolled, high relative humidity conditions often lead to more than just uncomfortable conditions. These conditions also support the formation of mold or the generation of other microbes within the building and in the duct work, which can lead to what is known as Sick Building Syndrome. ASHRAE Draft Standard 62-1892 recommends the use of make-up air (but limits levels of relative humidity) to help overcome these problems, which also helps to improve Indoor Air Quality (IAQ) issues. In order to follow the standard, increased dehumidification capacity independent of cooling demands is necessary.

Because of the inability of typical air conditioning equipment to control the high relative humidity conditions found in most buildings, the 1997 ASHRAE Handbook of Fundamentals climate data included peak dew point conditions, as well as peak sensible load conditions, and peak wet bulb conditions. The inclusion of peak dew point conditions allows the air conditioning equipment to be more accurately sized because many geographic regions have a higher Btu/h load at the peak dew point condition than at the previously listed corresponding peak sensible or peak wet bulb conditions.

One solution to the problems associated with typical air conditioning equipment is to design a conditional air conditioning system using a refrigeration circuit that is sized for the total heat load using the climatic design data from the 1997 ASHRAE Handbook of Fundamentals. The air conditioner capacity would be sized based on the highest of either the peak temperature (sensible) condition or the peak moisture (wet bulb and dew point) condition, whichever condition results in the highest total Btu/h requirement. Although this would allow the equipment to control both sensible and latent loads, it would likely over-cool the space and require reheating the supply air to meet the comfort zone conditions.

Another solution is to use a desiccant cooling system. A desiccant wheel or belt is used to remove moisture (latent heat) from an air supply. In typical applications, about 75% of the desiccant wheel is in the target air path as it rotates. The other 25% of the wheel is in a wedge-shaped regeneration chamber. Regeneration is accomplished by passing hot air (usually over 140° F.) through the wheel, which provides a greater attraction for water than the desiccant. This type of system can provide close and independent control of humidity and temperature. The advantage of the system is that it relies on low cost heat sources for the regeneration, thus providing better humidity control and lower overall energy costs than a conventional air conditioning unit. The problem is that desiccant cooling systems do not reduce the energy load. They simply replace latent load with increased sensible (heat) load, i.e., the moist air becomes drier but hotter air.

Industry reports on the self-storage business indicate that most new self-storage facilities include climate controlled units. However, as discussed above, most air conditioning units control temperature (sensible loads) well, but humidity (latent) loads poorly. While dehumidification has been a challenge for human comfort with traditional air conditioning applications (with a relatively small temperature range of 73-78° F.), it is even more difficult for a warehouse with a much wider temperature range (about 50° to about 80° F.).

Ideally, climate controlled warehouse/self-storage units want to hold the temperature between about 50° and about 80° F. and the relative humidity (RH) at about 60% or less. A relative humidity less than about 50% is desired because it eliminates condensation, prevents bacteria growth, mold, and mildew, and stops destructive corrosion. The low moisture level also stops dust-mite reproduction, and discourages pests, such as spiders, fleas, cockroaches, and silverfish. "Total climate control" is the new, more descriptive term used in the self-storage industry to refer to both temperature and humidity control. The Total climate control range for storage units are shown in FIG. 1 over the ASHRAE's comfort zone for winter (heating) and summer (cooling).

Therefore, there remains a need for a system which allows independent control of temperature and humidity.

SUMMARY OF TH INVENTION

The present invention meets that need by providing a climate control system for a storage unit. The system includes a reverse cycle chiller comprising: a variable capacity compressor; a reversing valve in fluid communication with the variable capacity compressor; an air side heat exchanger in fluid communication with the reversing valve; and a fluid side heat exchanger in fluid communication with the reversing valve and the air side heat exchanger. It also includes a fluid supply line in fluid communication with an outlet of the fluid side heat exchanger; a fluid return line in fluid communication with an inlet of the fluid side heat exchanger and the fluid supply line; at least one hydronic coil in optional fluid communication with the fluid supply line and the fluid return line, the at least one hydronic coil located in a room to be controlled; a controller in communication with the reverse cycle chiller and the at least one hydronic coil; an ambient temperature sensor in communication with the controller; an ambient humidity sensor in communication with the controller; a room temperature sensor in communication with the controller, the room temperature sensor positioned in the room; and a room humidity sensor in communication with the controller, the room humidity sensor positioned in the room.

Another aspect of the invention is a method of controlling the climate in a storage unit. The method includes providing a reverse cycle chiller as described above; connecting the at least one hydronic coil to the fluid supply line and the fluid return line; selecting a desired temperature range and a desired humidity range for the room; measuring an ambient temperature and an ambient humidity; determining a reverse cycle chiller mode and a fluid outlet temperature for the fluid side heat exchanger from the measured ambient temperature and ambient humidity; controlling the reverse cycle chiller to provide the mode and the fluid outlet temperature for the fluid side heat exchanger; measuring a room temperature and a room humidity; determining a temperature change for the room and a humidity change for the room from the measured room temperature and room humidity and the desired temperature range and humidity range; and controlling fluid flow to the at least one hydronic coil until the temperature change and humidity change have been achieved.

DETAILED DESCRIPTION OF THE INVENTION

The present invention is capable of heating, cooling, and dehumidification as required using a refrigeration cycle with a variable capacity compressor. It addresses the temperature and humidity range control needed for climate controlled warehousing and self-storage units, while protecting the stored items from damage associated with high humidity. Because occupancy is only transitory in nature, comfort and fresh air requirements are not managed.

The present invention involves a reverse cycle chiller system with a fluid (typically a water/glycol mixture) solution circuit connected to one or more hydronic (radiant and/or fan) coil(s). The individual hydronic coils can be connected or disconnected without interrupting the chiller system operation. This would allow the facilities manager to convert a non-climate controlled storage unit to a total climate controlled unit simply by adding a hydronic coil to the storage unit and hooking into the supply and return lines of the chiller without interrupting the chiller operation. The hydronic coil can include quick-connect hose couplings that can be coupled and de-coupled to the chiller system enabling a retrofit of the storage unit for total climate control which enables the owner to generate higher rent rates. Thus, the chiller system and control method enable variable capacity control to the hydronic (radiant or fan) coil(s) that control both sensible (dry bulb) and latent (wet bulb) loads in one or more individually controlled rooms.

Figure 1:
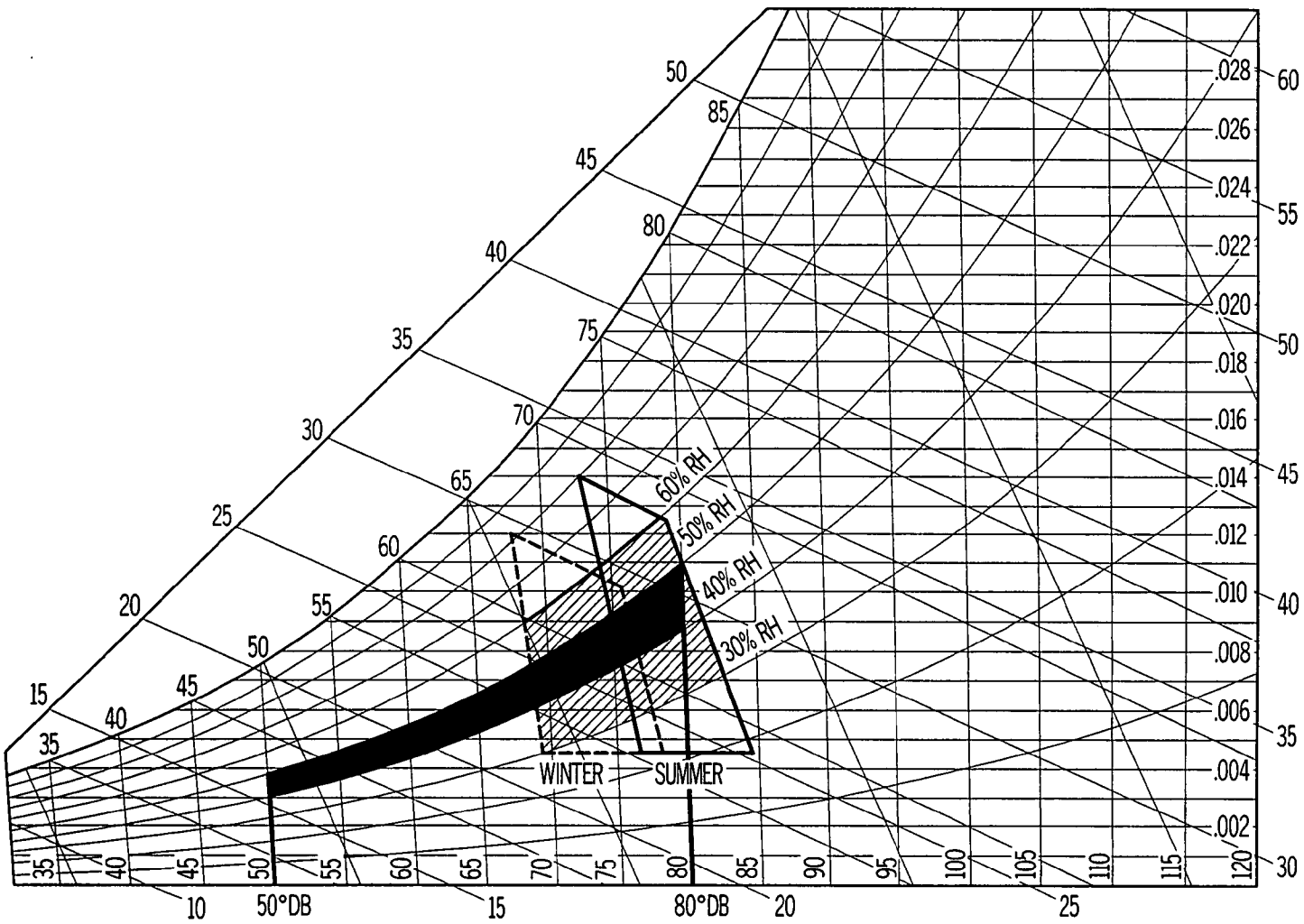
FIG. 1 is a psychrometric chart overlapping the self-storage Total Climate Control zone over the ASHRAE Comfort Zone for human occupancy.
Figure 2:
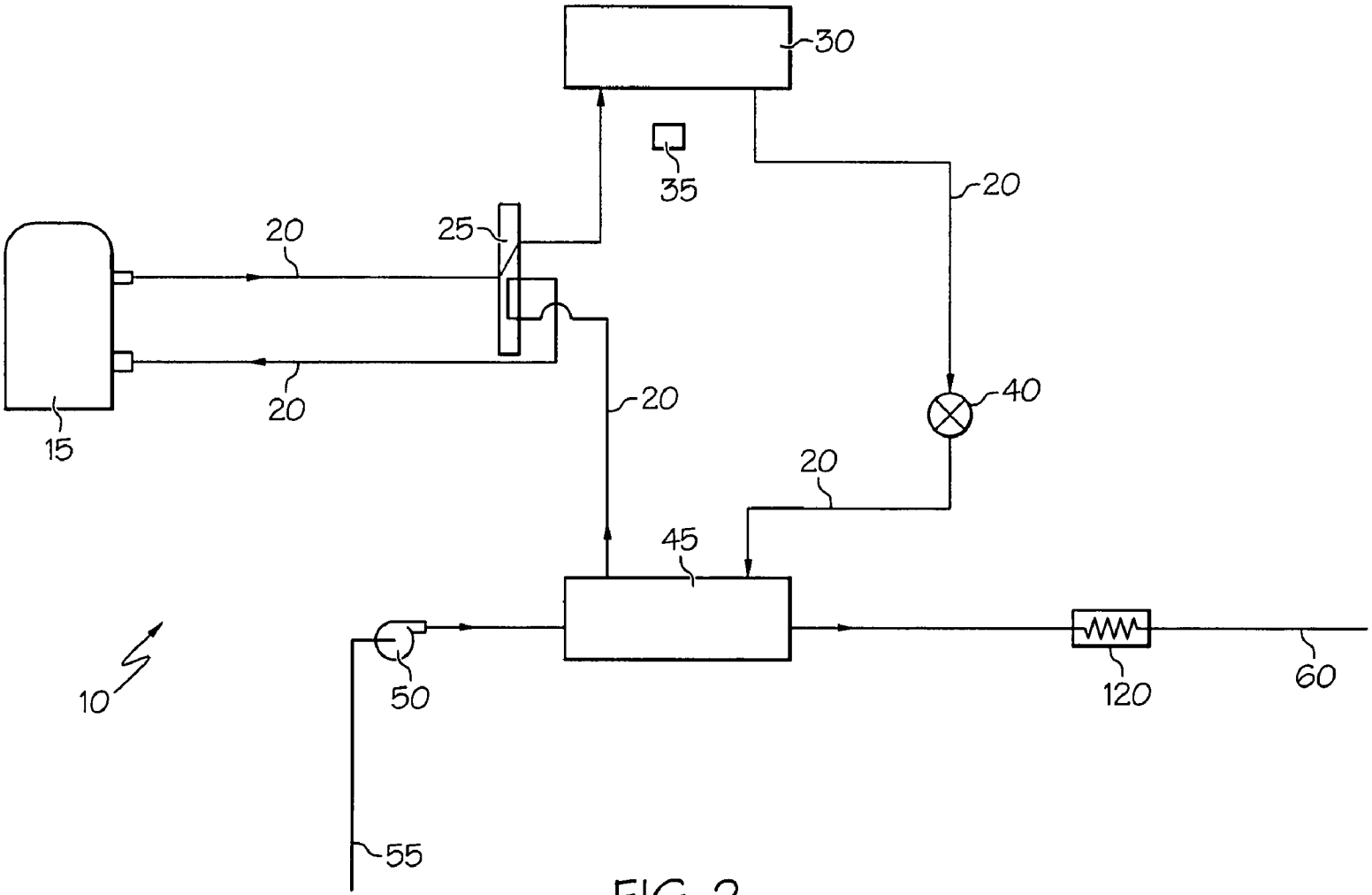
FIG. 2 is a schematic diagram of the one embodiment of the system of the present invention.

Referring to FIG. 2, a reverse cycle chiller 10 is shown. The chiller's refrigerant system can be used in either an air conditioning mode or a heating mode.

In the air conditioning mode, high temperature and pressure (superheated) discharge gas (refrigerant) from a variable capacity compressor 15 is routed through the refrigerant lines 20, through the reversing valve 25, to the air side heat exchanger (condenser) 30. The refrigerant rejects heat into the outdoor air moved by outdoor fan 35, and changes the refrigerant from gas to a cooler high pressure liquid. The high pressure liquid refrigerant then goes through the refrigerant lines 20, to a metering device 40, where its temperature and pressure drop as it enters the fluid side heat exchanger (evaporator) 45. In the fluid side heat exchanger 45, the refrigerant absorbs heat, which cools the fluid moved by the circulating pump 50. The circulating pump 50 moves the fluid from the return fluid line 55 through the fluid side heat exchanger 45 to the supply fluid line 60. The refrigerant returns through the reversing valve 25 to the variable capacity compressor 15 through the refrigerant lines 20, as a superheated, low pressure gas to repeat the refrigerant cycle.

In the heating mode, the refrigerant flows from the variable capacity compressor 15 through the reversing valve 25 to the fluid side heat exchanger (now condenser) 45, where it rejects heat into the fluid. This heats the fluid moved by the circulating pump 50. The cooler liquid refrigerant is routed through the metering device 40 to the air side heat exchanger (now evaporator) 30. The refrigerant absorbs heat from the outside air moved by outdoor fan 35. From the air side heat exchanger 30, the superheated, low pressure gas (refrigerant) is returned through the reversing valve 25, back to the compressor 15 to repeat the refrigerant cycle.

In one embodiment, the variable capacity compressor 15 can be a time proportioned scroll compressor. One example of a time proportioned scroll compressor is the Copeland Digital Scroll™ compressor (available from Emerson Climate Technology Inc. of Sidney Ohio). The Copeland Digital Scroll™ is a time proportioned compressor that utilizes a compressor controller to adjust its capacity precisely to its demand every 20 seconds. This varies the volume of refrigerant gas in the refrigerant circuit to tightly control compressor capacity throughout the range of about 10 to 100% of its full capacity.

It has been found that when a single capacity (non-variable) compressor is used in refrigeration systems, the compressor does more work than is needed, with the result that the desired set point of the system may be overshot. In addition, the non-variable compressor does not have the precision capacity control needed to maintain a constant condition while subjected to changing loads. By using a variable capacity compressor 15 in the chiller system 10, the chiller can adjust its output capacity to provide a constant outlet condition (leaving water temp (LWT)) from the fluid side heat exchanger 45 over a range of fluid flow rates and load changes (temperature and/or humidity). As each hydronic coil is energized or de-energized, the compressor and chiller system adjusts to the new load requirement.

Other types of variable capacity compressors can be used. For example, the necessary modulation can also be achieved by using: a tandem compressor with two or more single speed compressors having a single suction and discharge manifold; a tandem compressor with a single-speed compressor and a variable-capacity compressor; a variable speed scroll or piston type compressor (which uses synchronous motors whose speed may be varied by varying the hertz input to the motor, which causes variation in work output); or an infinitely adjustable capacity screw type compressor with a sliding valve; or combinations thereof.

Figure 3:
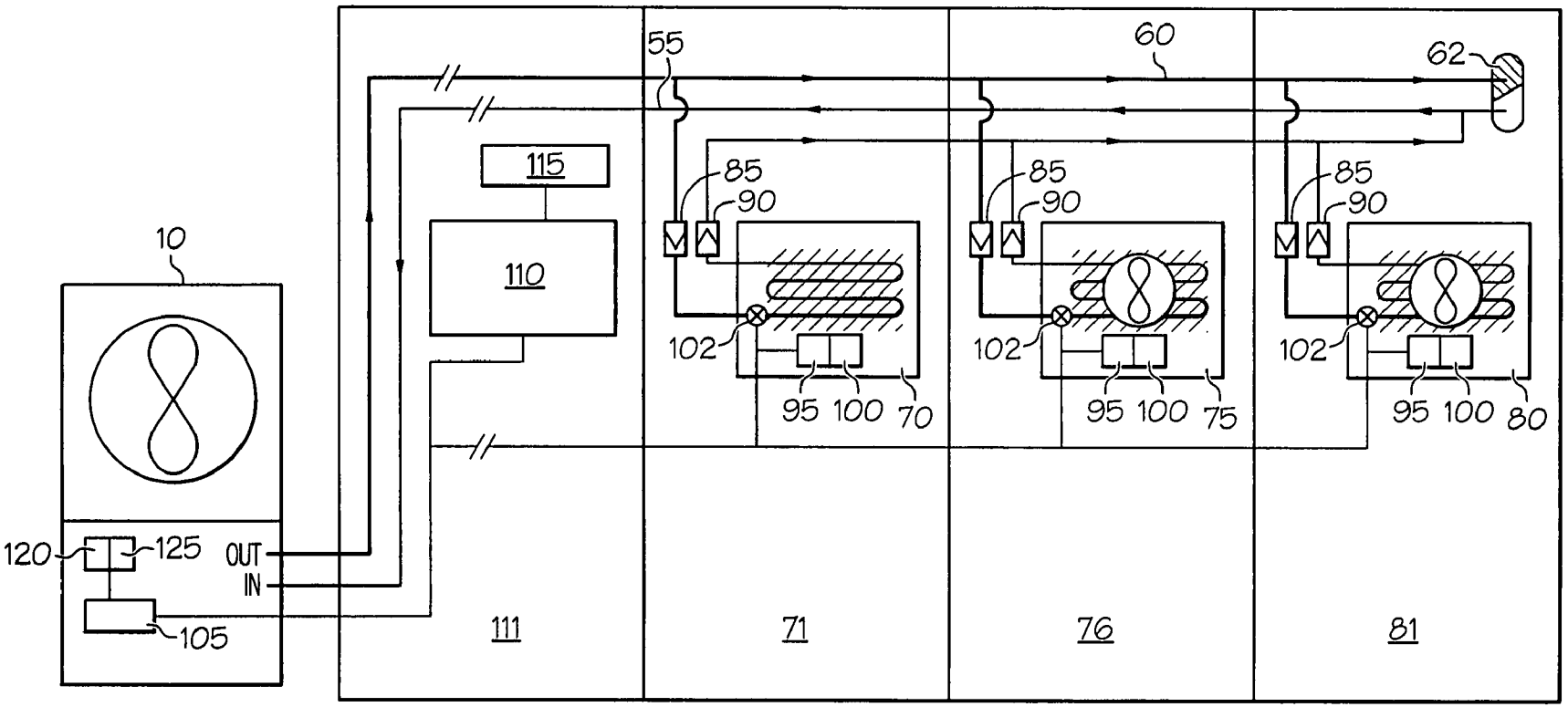
FIG. 3 is a refrigerant diagram of one embodiment in the air conditioning mode of the reverse cycle chiller of the basic system of the present invention.

FIG. 3 shows a schematic of the chiller system. There is the reverse cycle chiller 10, including the supply fluid line 60, the return fluid line 55, and one or more hydronic coils 70, 75, and 80. Hydronic coil 70 is in storage room 71, hydronic coil 75 is in storage room 76, and hydronic coil 80 is in storage room 81. Hydronic coils 70, 75, and 80 could be of the same type or of different types. For example, the hydronic coils can be radiant, or they can include fans. They can also be wall mounted or ceiling mounted. Each hydronic coil 70, 75, and 80 is attached to the supply fluid line 60 and the return fluid line 55. These connections can be made using a quick-connect coupling, if desired. The supply line coupling can include a flood safe shutoff valve 85, if desired. The return line coupling can include a check valve 90, if desired. There can be a bypass valve 62 between the supply fluid line 60 and the return fluid line 55, if desired. The bypass valve helps to ensure the chiller fluid being circulated is the minimum required. The amount of chiller fluid flowing in the system depends on the flow rate of the chiller and the required usage at any given time. For example, if the minimum chiller fluid flow rate is 12 gallons per minute (gpm), and only one hydronic coil has an open valve with a flow rate of 2 gpm, then 10 gpm will flow through the bypass valve. If there were six open valves of 2 gpm each, then no fluid would flow through the bypass valve. The bypass valve can operate automatically, if desired.

The reverse cycle chiller 10, can include at least one temperature sensor 95 (for example, a thermostat), and at least one humidity sensor 100 (for example, a humidistat). It can also include one or more programmable logic (system) controllers 105. It can also include a remote master display controller 110, if desired. There can be an optional modem 115. Additionally, there can be a temperature sensor 95, a humidity sensor 100, and a fluid solenoid valve 102 for each hydronic coil.

The water side heat exchanger can be located above or below the air side heat exchanger in the reverse cycle chiller 10, as desired. Positioning the water side heat exchanger above the air side heat exchanger could be beneficial because the circulating pump would pump against a smaller vertical column of water. Therefore, the pump would have less work to do, making it more efficient.

The reverse-cycle chiller can be mounted on the wall, such as an exterior building wall, if desired. The reverse cycle chiller can also be constructed in modules, if desired. Both modules could be installed on the wall as a single unit. Alternatively, it could be separated into two modules, with the air side heat exchanger and fan mounted in one place (on an exterior building wall for example), and the water side heat exchanger, circulating pump, etc. located in another place (inside the building, for example). The two modules would be linked by appropriate connections (e.g., refrigerant piping and electrical wiring).

The chiller's fluid should be chosen so that a 30° F. solution does not freeze. This is a temperature below the dew point necessary to facilitate dehumidification levels at or below 50% RH. Water can be used as the chiller fluid, and it can contain an appropriate amount of glycol to reduce the freezing point, if desired.

Figure 4:
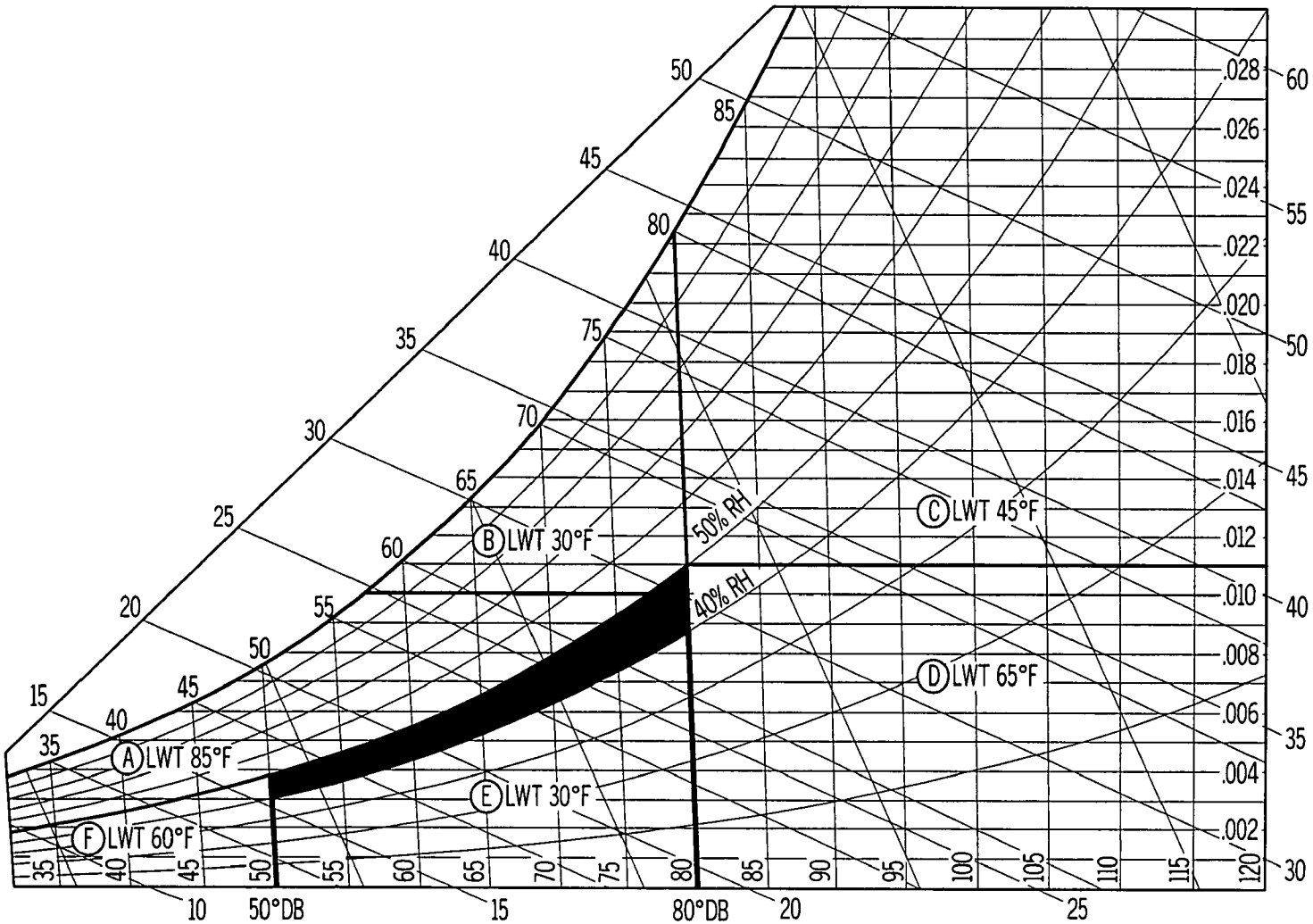
FIG. 4 is a psychometric chart divided into six zones used in one embodiment of the basic system of the present invention.

A desired air temperature range and humidity range to be maintained in each storage unit or warehouse room is selected, for example, between 50-80° F. and less than 50% relative humidity. These ranges are shown in FIG. 4.

In the reverse cycle chiller 10, the system's programmable logic controller (PLC) 105 includes software having the properties of air (found on a psychrometric chart). The system control method of the chiller is programmed into the PLC 105, which divides a psychrometric chart of air into two or more zones. FIG. 4 shows six zones. Inputs to the PLC 105 include ambient temperature from one or more temperature sensors 120, ambient humidity from one or more humidity sensors 125, and the temperature (LWT) of chiller's water/glycol solution from the fluid side heat exchanger 45 going to the supply fluid line 60. The ambient temperature and humidity inputs determine which zone of the psychrometric chart the ambient is in. This is used to set the chiller's mode between air conditioning and heating. These inputs also determine the chiller's LWT from the fluid side heat exchanger 45 supplied to the storage units or warehouse's supply fluid line 60 so it has the temperature necessary to cool, dehumidify, or heat.

The chiller's LWT from the fluid side heat exchanger 45 is in another input to the PLC 105. It is used to manage an analog output to the controller for the variable capacity compressor 15. A very tight compressor capacity control is needed for dehumidification to maintain the LWT at a constant temperature below the dew-point in order to maximize dehumidification while also adjusting for total system load.

The reverse cycle chiller 10 uses the ambient temperature and humidity conditions to determine the chiller's system mode and the LWT needed to condition the storage units or warehouse rooms. This is appropriate because the source of the temperature and humidity loads on the warehouse and storage units is the ambient conditions. For example, if outside ambient conditions are 90° F. and raining (100% RH), the LWT supplied to the hydronic coils is selected to provide sensible cooling and dehumidification. Likewise, if the conditions are 60° F. and raining (100% RH), the LWT supplied to the hydronic coils is selected to provide primarily dehumidification with little sensible cooling. If outdoor ambient is hot (110° F.) and dry (<50% RH), then the LWT supplied is selected to provide sensible cooling only.

The psychrometric chart shown in FIG. 4 divides the ambient conditions into six zones that control the reverse cycle chiller's mode and leaving water temperature (LWT). More (or less) zones could be programmed into the chiller's system programmable logic controller 105 to include additional (or fewer) LWT conditions to more closely match sensible and latent loads, if desired.

Zone A shown in FIG. 4 would put the reverse cycle chiller in a heating (heat pump) mode with an 85° F. LWT. If the outside ambient temperature is very cold and not enough heat is absorbed from the air side heat exchanger 30 to provide 85° F. water/glycol, then additional heat can be provided from an in-line heater 120 to assist in supplying the 85° F. LWT.

Zone B shown in FIG. 4 would put the reverse cycle chiller in an air conditioning mode with a 30° F. LWT to maximize dehumidification (latent cooling).

Zone C shown in FIG. 4 would set the mode for air conditioning with a LWT at 45° F. used to provide both sensible and latent cooling.

Zone D shown in FIG. 4 would set the mode for air conditioning with a LWT at 65° F. used primarily for sensible cooling.

Zone E shown in FIG. 4 is within the design conditions (50°-80° F. and ≦50% RH). This condition requires no action, but it sets a default LWT at 30° F. so that the system is ready for dehumidification.

Zone F shown in FIG. 4 would put the reverse cycle chiller mode in heating (heat pump mode) with a LWT of 60° F.

Inside the warehouse or storage units, each room 71, 76, and 81 has one or more hydronic coils 70, 75, and 80. When the temperature and/or humidity condition in a room moves outside the desired conditions (such as, 50-80° F. and ≦50% RH), the controller opens a valve 102, such as a solenoid valve, and circulates the water/glycol solution through the coil to bring the room condition back into the desired temperature and/or humidity range. If there is a hydronic fan coil, the controller also selects fan speed.

Alternatively, the temperature sensor could be a thermostat, and the humidity sensor could be a humidistat. In this embodiment, the thermostat and humidistat could control the valve 102.

The system allows temperature control independent of humidity control. If the temperature is within the desired range, but the humidity is not, then dehumidification can take place with any heating or cooling. If the humidity is within the desired range, but the temperature is not, then heating or cooling can take place without any dehumidification. If both the temperature and humidity are outside the desired ranges, then both heating or cooling and dehumidification can take place.

The Programmable Logic Controller (PLC) in the chiller system includes a software program that divides a psychrometric chart of dry air into two or more zones The PLC uses the ambient temperature and relative humidity conditions as inputs to determine the needed chiller LWT. The LWT is also an input to the PLC that provides the analog output to the compressor controller that manages the precision capacity control required of the variable capacity compressor. The ambient conditions could be the outdoor conditions, or they could be the building conditions if the room is inside a building.

The reverse cycle chiller system is capable of maintaining each individual storage room that is provided with the appropriate climate control hardware (hydronic coils and controls) within a temperature range of about 50° to about 80° F. while holding the relative humidity at or below about 50% RH. In cold winter climates where additional heating capacity is needed above that provided by the reverse cycle chiller (in heat pump mode), an in-line supplemental heating unit can be included and regulated by the system controller.

The system is designed to be flexible in that the climate control hardware can be added or removed in each room as needed, if the storage building (or warehouse) is built (or retrofitted) with a chiller system that includes provisions for tapping into the chiller's supply and return lines and electrical system. The climate control hardware for each storage room can be an assembly that includes a hydronic coil (radiant or fan), a solenoid valve, temperature and humidity sensors, and associated wiring plugs, and chiller quick-release couplings. The climate control hardware can be moved from room to room as needed. Alternatively, the climate control hardware could remain in the rooms and be connected or disconnected as needed.

The quick-release coupling can be part of both hose assemblies connected to the hydronic coil. The quick-release coupling is suitable for medium operating pressure and has a flat faced valve that does not allow spillage or air inclusion during connection and disconnection. It is suitable to be assembled on pre-charged systems and wherever, for maintenance reasons, it is necessary to connect-disconnect without fluid loss. The hydronic coil and hose assemblies for each room can be pre-charged with chiller fluid (water/glycol). The pre-charged hydronic coils and hoses with the quick-connect coupling enable the facility manager to convert a non-climate controlled room to a climate controlled room simply by connecting the coil's hoses to the chiller system without interrupting the chiller operation.

In one embodiment, the chiller system supply line could be equipped with the male coupling end in each room, while the hydronic coil's supply hose could be equipped with the female coupling end. Likewise, the chiller return line could be equipped with the female coupling end, while the coil's return hose could be equipped with the male coupling end. This ensures the coil hoses are connected correctly to the chiller's supply and return lines (without interchanging the connections).

In one embodiment, each storage room can also use combined sensors and controllers for humidity and temperature, such as thermostats and humidistats. The thermostat and humidistat can operate a solenoid valve on the hydronic coil used to condition each individual unit. When the system calls for room conditioning for heating, cooling, or dehumidification, the solenoid valve opens, and the chiller fluid is circulated through the hydronic coil until the room condition is satisfied. The solenoid valve would then close.

The thermostat and humidistat can be used with a basic PLC. In this arrangement, the system could include as many hydronic coils as the chiller capacity would allow. The temperature and humidity in each unit could be controlled, but system might not allow recordation of the conditions. Alternatively, more complex PLCs could be used which would allow collection and storage of temperature and humidity conditions, if desired.

Humidity and temperature data can be logged by a master display 120 that supervises a field network of controllers. In a chiller system with either a basic PLC or a more complex PLC, the master display can be viewable by facility managers and capable of setting alarms. The master display can have communications options 115 (e.g., fax, email, and internet), if desired. The logged data (temperature and humidity) also can be used to provide verification of system integrity to the facility managers and storage room tenants.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A climate control system for a storage unit comprising:

a reverse cycle chiller comprising:

a variable capacity compressor;

a reversing valve in fluid communication with the variable capacity compressor;

an air side heat exchanger in fluid communication with the reversing valve; and a fluid side heat exchanger in fluid communication with the reversing valve and the air side heat exchanger;

a fluid supply line in fluid communication with an outlet of the fluid side heat exchanger;

a fluid return line in fluid communication with an inlet of the fluid side heat exchanger;

a bypass valve in fluid communication with the fluid supply line and the fluid return line, the reverse cycle chiller, the fluid supply line, the fluid return line, and the bypass valve forming a first fluid flow path;

at least one hydronic coil in optional fluid communication with the fluid supply line and the fluid return line, the at least one hydronic coil located in a room to be controlled, a removable connection between the at least one hydronic coil and the fluid supply line connectable to allow fluid communication and disconnectable to prevent fluid communication, and a removable connection between the at least one hydronic coil and the fluid return line connectable to allow fluid communication and disconnectable to prevent fluid communication so that the climate in the room can be controlled when required and not controlled when not required;

a controller in communication with the reverse cycle chiller;

an ambient temperature sensor in communication with the controller;

an ambient humidity sensor in communication with the controller, the controller responsive to the ambient temperature sensor and the ambient humidity sensor, wherein the controller controls a temperature of a fluid in the fluid supply line;

a room temperature sensor positioned in the room;

a room humidity sensor positioned in the room; and a valve positioned in the connection between the at least one hydronic coil and the fluid supply line, the valve responsive to the room temperature sensor and the room humidity sensor, wherein the valve opens and closes to control fluid flow to the at least one hydronic coil, wherein the reverse cycle chiller, the fluid supply line, the fluid return line, the bypass valve, and the at least one hydronic coil forming a second fluid flow path;

wherein fluid flows through the first fluid flow path when no hydronic coil is connected, and wherein fluid flows through the first and second fluid flow paths when the at least one hydronic coil is connected.

2. The climate control system of claim 1 wherein the variable capacity compressor is selected from a time proportioned scroll compressor; a tandem compressor with two or more single speed compressors having a single suction and discharge manifold; a tandem compressor with a single-speed compressor and a variable-capacity compressor; a variable speed scroll type compressor; a variable speed piston type compressor; an infinitely adjustable capacity screw type compressor with a sliding valve; or combinations thereof.

3. The climate control system of claim 1 wherein the controller is a programmable logic controller.

4. The climate control system of claim 1 wherein the at least one hydronic coil is selected from radiant hydronic coils and hydronic fan coils.

5. The climate control system of claim 1 wherein at least one room temperature sensor is a thermostat.

6. The climate control system of claim 1 wherein at least one room humidity sensor is a humidistat.

7. The climate control system of claim 1 wherein the connection between the at least one hydronic coil and the fluid supply line or between the at least one hydronic coil and the fluid return line comprises a quick connect coupling.

8. The climate control system of claim 7 wherein the connection between the at least one hydronic coil and the fluid supply line further comprises a flood safe shutoff valve between the quick connect coupling and the valve.

9. The climate control system of claim 7 wherein the connection between the at least one hydronic coil and the fluid return line further comprises a check valve between the at least one hydronic coil and the quick connect coupling.

10. The climate control system of claim 7 wherein the connection between the at least one hydronic coil and the fluid supply line further comprises a flood safe shutoff valve between the quick connect coupling and the valve and wherein the connection between the at least one hydronic coil and the fluid return line further comprises a check valve between the at least one hydronic coil and the quick connect coupling.

11. The climate control system of claim 1 further comprising a controller display in communication with the controller.

12. The climate control system of claim 1 further comprising a heater in communication with the fluid supply line and the controller.

13. A method of controlling the climate in a storage unit comprising:

providing a climate control system comprising:

a reverse cycle chiller comprising:

a variable capacity compressor;

a reversing valve in fluid communication with the variable capacity compressor;

an air side heat exchanger in fluid communication with the reversing valve; and a fluid side heat exchanger in fluid communication with the reversing valve and the air side heat exchanger;

a fluid supply line in fluid communication with an outlet of the fluid side heat exchanger;

a fluid return line in fluid communication with an inlet of the fluid side heat exchanger;

a bypass valve in fluid communication with the fluid supply line and the fluid return line, the reverse cycle chiller, the fluid supply line, the fluid return line, and the bypass valve forming a first fluid flow path;

at least one hydronic coil in optional fluid communication with the fluid supply line and the fluid return line, the at least one hydronic coil located in a room to be controlled, a removable connection between the at least one hydronic coil and the fluid supply line connectable to allow fluid communication and disconnectable to prevent fluid communication, and a removable connection between the at least one hydronic coil and the fluid return line connectable to allow fluid communication and disconnectable to prevent fluid communication;

a controller in communication with the reverse cycle chiller;

an ambient temperature sensor in communication with the controller;

an ambient humidity sensor in communication with the controller, the controller responsive to the ambient temperature sensor and the ambient humidity sensor;

a room temperature sensor positioned in the room;

a room humidity sensor positioned in the room; and a valve positioned in the connection between the at least one hydronic coil and the fluid supply line, the valve responsive to the room temperature sensor and the room humidity sensor, the reverse cycle chiller, the fluid supply line, the fluid return line, the bypass valve, and the at least one hydronic coil forming a second fluid flow path;

measuring an ambient temperature and an ambient humidity;

determining a reverse cycle chiller mode from a psychrometric chart having at least two zones and a fluid outlet temperature for the fluid side heat exchanger from the measured ambient temperature and ambient humidity;

controlling the reverse cycle chiller to provide the mode and the fluid outlet temperature for the fluid side heat exchanger;

circulating a fluid having the fluid outlet temperature through the first fluid flow path;

adjusting a capacity of the variable speed compressor to control an amount of fluid in the fluid flow path based on a system load;

connecting the at least one hydronic coil to the fluid supply line and the fluid return line with the connections when climate control of the room is required;

selecting a desired temperature range and a desired humidity range for the room;

measuring a room temperature with the room temperature sensor and a room humidity with the room humidity sensor;

determining a temperature change for the room and a humidity change for the room from the measured room temperature and room humidity and the desired temperature range and humidity range;

opening the valve and circulating fluid to the at least one hydronic coil in response to the determined temperature change and humidity change and closing the valve when the temperature change and humidity change have been achieved;

disconnecting the at least one hydronic coil to the fluid supply line and the fluid return line with the connections when climate control of the room is not required;

adjusting the amount of fluid through the bypass valve when the at least one hydronic coil is connected or disconnected based on the system load.

14. The method of claim 13 wherein the connection of the at least one hydronic coil to the fluid supply line or to the fluid return line is a quick connect coupling.

15. The method of claim 13 wherein the controller is a programmable logic controller.

16. The method of claim 13 wherein the reverse cycle chiller further comprises a controller display, and further comprising displaying data on the controller display.

17. The method of claim 13 wherein the reverse cycle chiller further comprises a heater in communication with the fluid supply line and the controller, and further comprising controlling the heater to provide the fluid outlet temperature for the fluid side heat exchanger.

18. The method of claim 13 further comprising connecting at least one hydronic coil to the fluid supply line and the fluid return line while the reverse cycle chiller is in operation.

19. The method of claim 13 further comprising disconnecting at least one hydronic coil while the reverse cycle chiller is in operation.

20. The method of claim 13 wherein the connection between the at least one hydronic coil and the fluid supply line further comprises a flood safe shutoff valve between the quick connect coupling and the valve and wherein the connection between the at least one hydronic coil and the fluid return line further comprises a check valve between the at least one hydronic coil and the quick connect coupling.

* * * * *